US007866904B2

(12) United States Patent
Bungert et al.

(10) Patent No.: US 7,866,904 B2
(45) Date of Patent: Jan. 11, 2011

(54) DESKTOP CARD PRINTER WITH INDENT PRINTING APPARATUS AND METHOD OF PRINTING

(75) Inventors: Lyle Bungert, Lakeville, MN (US); David Alvig, Richfield, MN (US); Peter Schuller, Elko, MN (US); Bryan Hoeve, Farmington, MN (US); Jerry Steinbach, Champlin, MN (US)

(73) Assignee: DataCard Corporation, Minnetonka, MN (US)

( * ) Notice: Subject to any disclaimer, the term of this patent is extended or adjusted under 35 U.S.C. 154(b) by 912 days.

(21) Appl. No.: 11/682,570

(22) Filed: Mar. 6, 2007

(65) Prior Publication Data

US 2008/0219745 A1 Sep. 11, 2008

(51) Int. Cl.
*B41J 3/38* (2006.01)
*B44B 5/00* (2006.01)

(52) U.S. Cl. ..... 400/134; 400/129; 101/18; 101/25

(58) Field of Classification Search ..... 400/129, 400/130, 134; 101/4–6, 8, 9, 11, 18, 25, 101/27

See application file for complete search history.

(56) References Cited

U.S. PATENT DOCUMENTS

| | | | | |
|---|---|---|---|---|
| 1,514,109 | A | | 11/1924 | Stenstrom |
| 1,910,278 | A | | 2/1933 | Browning |
| 2,221,424 | A | | 11/1940 | Rexford et al. |
| 2,293,013 | A | | 8/1942 | Bradner et al. |
| 2,558,877 | A | | 7/1951 | Ress |
| 2,585,410 | A | | 2/1952 | Schott |
| 2,867,001 | A | | 1/1959 | Lewis et al. |
| 3,097,592 | A | | 7/1963 | Friedman |
| 3,124,064 | A | * | 3/1964 | Schick ..... 101/18 |
| 3,302,558 | A | | 2/1967 | Otto |
| 3,387,330 | A | | 6/1968 | Lemelson |
| 3,842,956 | A | | 10/1974 | Reilly et al. |
| 3,861,512 | A | | 1/1975 | Coriasco et al. |
| 4,063,500 | A | * | 12/1977 | Abe ..... 101/25 |
| 4,088,216 | A | | 5/1978 | LaManna et al. |
| 4,091,910 | A | | 5/1978 | Bolton et al. |
| 4,180,338 | A | | 12/1979 | LaManna et al. |
| 4,271,012 | A | | 6/1981 | LaManna et al. |
| 4,327,635 | A | | 5/1982 | Kelly et al. |
| 4,378,733 | A | | 4/1983 | Polad et al. |
| 4,431,320 | A | | 2/1984 | Alff et al. |
| 4,580,492 | A | | 4/1986 | Troyan et al. |
| 4,688,785 | A | | 8/1987 | Nubson et al. |
| 4,747,706 | A | | 5/1988 | Duea |

(Continued)

OTHER PUBLICATIONS

International Search Report of PCT/US2008/054890, dated Jun. 27, 2008.

(Continued)

*Primary Examiner*—Leslie J Evanisko
(74) *Attorney, Agent, or Firm*—Hamre, Schumann, Mueller & Larson, P.C.

(57) ABSTRACT

An indent printing apparatus that is capable of indent printing on both sides of a document. A desktop card printer that uses the indent printing apparatus, a method of personalizing a document in the printer, and a ribbon cartridge used with the indent printing apparatus are also disclosed. The indent printing apparatus has first and second indenting mechanisms and uses first and second indent printing ribbon cartridges to enable indent printing on both side surfaces of the document.

13 Claims, 6 Drawing Sheets

U.S. PATENT DOCUMENTS

| | | | |
|---|---|---|---|
| 4,755,069 | A | 7/1988 | LaManna et al. |
| 4,866,545 | A | 9/1989 | LaManna et al. |
| 4,900,168 | A | 2/1990 | LaManna et al. |
| 5,044,791 | A | 9/1991 | Lawson |
| 5,070,781 | A | 12/1991 | Lundstrom et al. |
| 5,320,435 | A | 6/1994 | Warwick et al. |
| 5,453,821 | A | 9/1995 | Howes, Jr. et al. |
| 5,762,431 | A | 6/1998 | Pawelka et al. |
| 5,886,726 | A | 3/1999 | Pawelka et al. |
| 6,027,265 | A | 2/2000 | Parker et al. |
| 6,065,884 | A | 5/2000 | Parker et al. |
| 6,352,206 | B1 | 3/2002 | Ashley et al. |
| 6,902,107 | B2 | 6/2005 | Shay et al. |
| 2005/0104281 | A1 | 5/2005 | Stender et al. |

OTHER PUBLICATIONS

Written Opinion of the International Searching Authority of International Application No. PCT/US2008/054890, dated Jun. 27, 2008.

* cited by examiner

DESKTOP CARD PRINTER WITH INDENT PRINTING APPARATUS AND METHOD OF PRINTING

FIELD

This disclosure describes an indent printing apparatus that can indent print on both sides of a document, for example a card such as a credit card, a driver's license, an identification card, and the like, or other types of documents including passports.

BACKGROUND

It is known to indent characters into the surface of a plastic card in a process called indent printing. The indented characters can be, for example, an account number or a verification code. A typical indent printer indent prints a character into a card by simultaneously contacting a male punch and a corresponding anvil respectively against the front and the back surface of the card with an indent ribbon disposed between the male punch and one surface of the card so that the male punch drives the ribbon into the surface of the card when the male punch contacts the ribbon and the anvil contacts the opposite surface of the card. The punch creates an indentation in the card surface and the ribbon deposits a color material, for example a dye or resin, in the resulting indentation, thereby making the indented character easier to see. In the case of credit cards, indent printing often occurs on the back surface of the credit card but is sometimes done on the front surface.

In indent printing, the indented character is an indent in one planar side surface of the card, with the character being prevented from projecting from the opposite planar surface of the card by the anvil disposed opposite the male punch.

Although existing indent printing technology is acceptable, further improvements to indent printing technology are desirable.

SUMMARY

An improved indent printing apparatus is provided. The indent printing apparatus is capable of indent printing on both sides of a document. A desktop document personalization machine, for example a card printer, that uses the indent printing apparatus, a method of personalizing a document in the machine, and a ribbon cartridge used with the indent printing apparatus are also disclosed. Additional embodiments are described where a print mechanism functions together with the indent printing apparatus to eliminate the need for an indent print ribbon. Therefore, as used herein, indent printing apparatus and indent printing mechanism includes a device with indent capability with or without an indent print ribbon.

The document can be, for example, an identity document, such as a plastic card including a financial (e.g. credit and debit) card, a drivers' license, an identification card, and other cards. Other documents, such as passports, can also be indent printed using the indent printing apparatus disclosed herein.

The indent printing apparatus is configured to indent characters including numbers, letters or symbols and combinations thereof on a document depending on the requirements of the user. The symbol can be a stamp such as a government seal. In one embodiment, indent characters are set in a predetermined pattern to allow linear indent printing generally across the first and/or second side surface of the document. This pattern could be used for indent printing a personal account number, a name or the like onto the document.

Further, the indent printing apparatus has first and second indenting mechanisms and uses first and second indent printing ribbon cartridges to enable indent printing on both side surfaces of the document.

The indent printing ribbon cartridges are removable to allow disposal of the cartridges or reloading of new indent ribbon into the cartridges. Each cartridge can have a housing with an interior space, a supply reel containing indent ribbon to be used for indent printing and a take-up reel for taking up used indent ribbon. The indent ribbon can be configured to provide one or a number of different color materials or properties, for example black, white, gray, red, metallic, holographic, fluorescent, and the like, and the material can be UV or heat curable. If desired, the cartridge can include a smart radio frequency identification ("RFID") tag, for example on the inside or outside thereof, that contains an antenna and a memory element for storing data, for example data relating to ribbon use and the amount of ribbon remaining.

DRAWINGS

DETAILED DESCRIPTION

Figure 1:
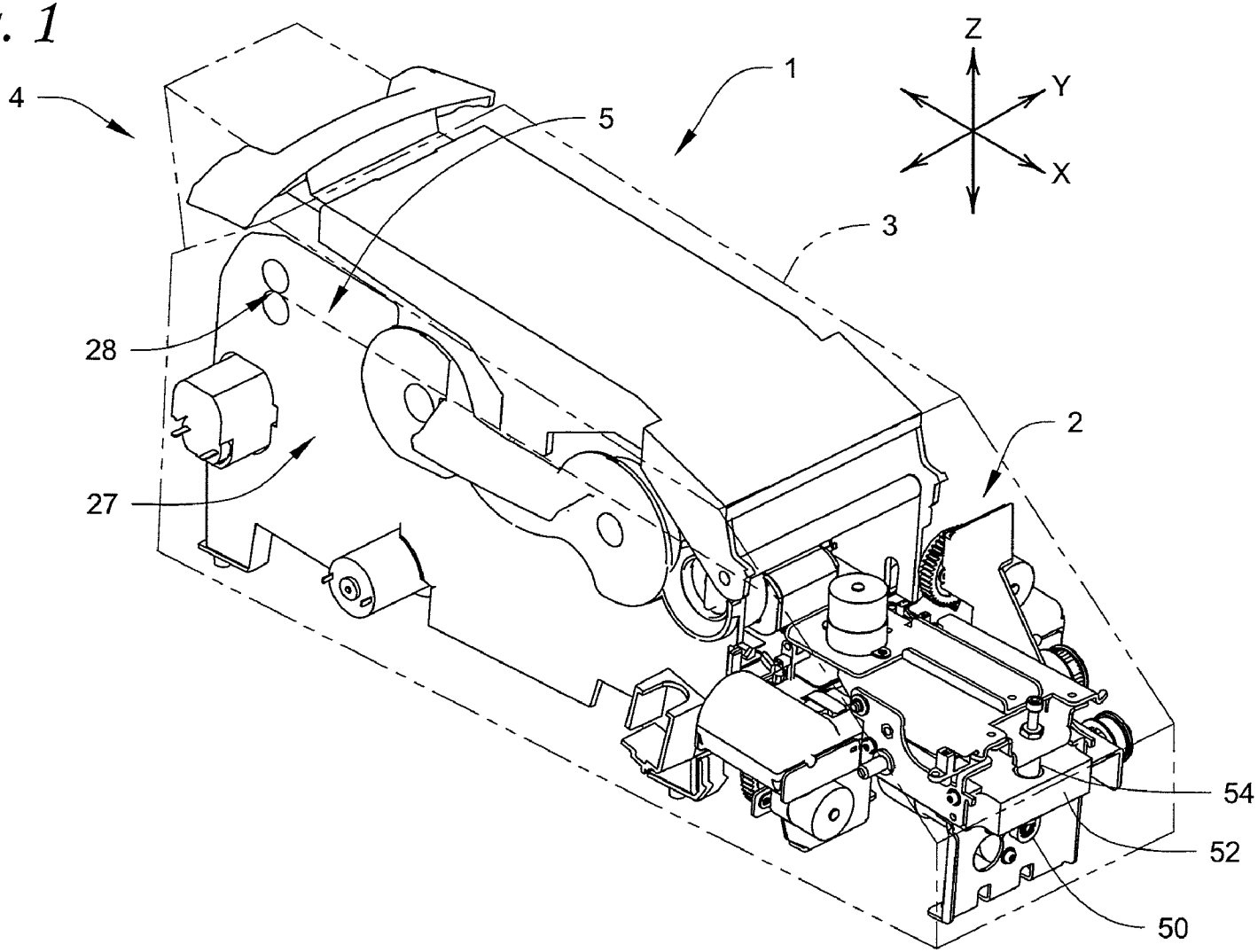
FIG. 1 is a perspective view of an indent printing apparatus housed within a desktop card printer.

An indent printing apparatus 2 that can indent print on both side surfaces of a document is illustrated in FIG. 1. The indent printing apparatus 2 is configured to indent characters including numbers, letters or symbols and combinations thereof on a document depending on the requirements of the user.

For sake of convenience, the document will be described herein as being a card, for example a financial (e.g. credit and debit) card, a drivers' license, an identification card, or other card. The card can be made of plastic, a composite, or other materials suitable for forming a card. It is to be realized that the document is not limited to cards and can be any document on which an indent printing operation is desired to be performed.

The words forward, reverse, upper, lower, rear, front, horizontal, vertical and the like are used herein with respect to the direction of movement of the card through the indent printing apparatus and associated desktop personalization machine, and the orientation of the card as it is transported.

The indent printing apparatus 2 is illustrated and will be described as used in a desktop card printer 1 as illustrated in FIG. 1. However, the indent printing apparatus 2 could be used in other systems as well, for example in a module of a central card issuance system, or by itself.

With reference to FIG. 1, the desktop card printer 1 is illustrated. The printer 1 includes a housing 3 (illustrated in dashed lines) having an input/output mechanism 4 in the form of a combined input/output hopper which can store a plurality of cards waiting to be processed, and which stores cards discharged from the housing 3. The card printer 1 also includes a card personalization mechanism 27, for example a thermal print mechanism for performing printing operations on the card. However, other card personalization mechanisms can be used in place of, or in addition to, a print mechanism.

The personalization mechanism 27 and the indent printing apparatus 2 are disposed along a single processing level. A card transport apparatus 28, for example rollers or other transport devices well know in the art, is provided for transporting a card through the housing 3 and to the personalization mechanism 27 and the indent printing apparatus 2.

Further information on input/output mechanisms and card transport mechanisms in card printers can be found in U.S. Pat. Nos. 5,762,431 and 5,886,726 and U.S. Patent Application Publication No. US 2005-0104281 A1.

In operation of the card printer 1, a card is fed from the input/output apparatus 4 into the housing 3. As an alternative to having the input/output apparatus 4, the housing 3 can have a slot whereby a user manually feeds a card into the housing 3.

Once the card enters the housing 3, the card transport apparatus 28 transports the card through the interior of the housing 3. The transport apparatus 28 moves the card along a transport path 5 using a series of rotating nip rollers or other transport apparatuses as is known in the art. In the card printer 1, as illustrated by the arrows in FIG. 1, an x-direction is defined along the transport path 5, a y-direction is perpendicular to the x-direction and parallel to the plane of the front and rear surfaces of a card as it moves through the printer 1, and a z-direction is perpendicular to both the x-direction and the y-direction.

The card transport apparatus 28 is configured such that a card entering the housing 3 travels along the transport path 5 from one end of the housing 3 to the other end, and then travels back along substantially the same transport path toward the output, where the card is discharged through an output that is different from the input. During transport, the card moves along the x-direction, with minimal or no y-direction and z-direction movement. In addition, the indent printing apparatus 2 is configured to have little or no x-direction or y-direction movement, with a portion thereof permitted z-direction movement.

The card transport apparatus 28 first transports the card from the input to the personalization mechanism 27 in the x-direction. The personalization mechanism 27 can then perform a desired personalization operation on the card if necessary. Personalization operations can include one or more of printing, embossing, laminating, laser engraving, magnetic stripe encoding, programming of a chip embedded in the card, and the like. The card transport apparatus 28 then transports the card from the personalization mechanism 27 to the indent printing apparatus 2 along the x-direction which performs indent printing on either one or both sides of the card.

As shown in FIG. 1, the indent printing apparatus 2 is located at the rear end of the housing 3. After indent printing of the card is complete, the card transport apparatus 28 transports the card back along the transport path 5 in the x-direction, back through the personalization mechanism 27, to the output where the card is discharged from the housing 2.

In the illustrated embodiment, cards are transported through the printer 1 in a generally horizontal orientation, with the front and back surfaces of the card generally parallel to the x-y plane. However in other embodiments, the cards may be transported in a generally vertical orientation.

Figure 2A:
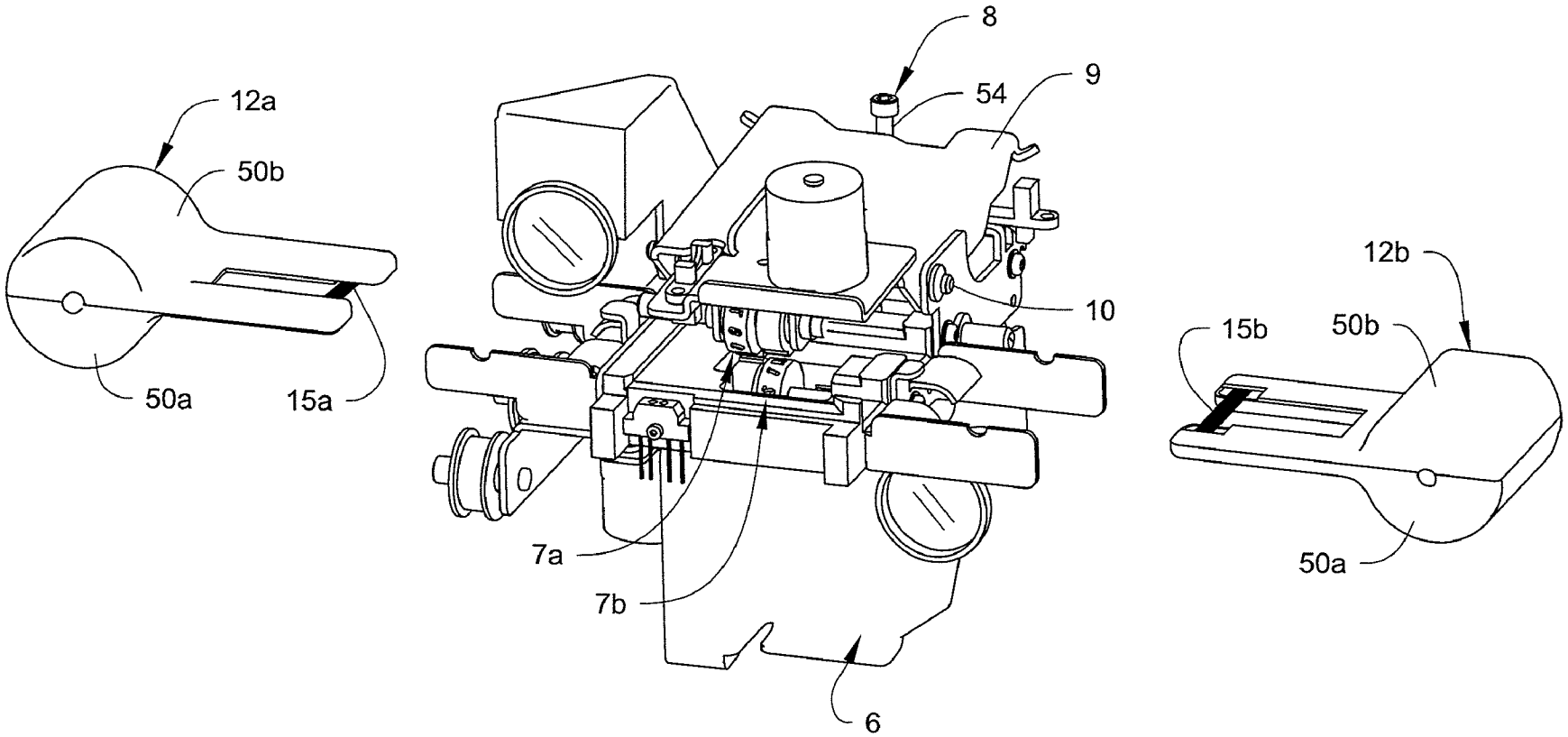
FIG. 2A is a perspective view of the indent printing apparatus.

With reference to FIG. 2A, details of the indent printing apparatus 2 are shown. The indent printing apparatus 2 includes a chassis 6 integrated within the housing 3. Supported on the chassis 6 are a first indenting mechanism 7*a*, a second indenting mechanism 7*b*, an actuator 8 and an actuator plate 9.

In the illustrated embodiment, the actuator 8 is configured to move vertically up and down to actuate the first indenting mechanism 7*a* toward and away from the second indenting mechanism 7*b* via the actuator plate 9. In particular, with reference to FIGS. 1 and 2A, the actuator 8 includes a cam 50 (visible in FIG. 1) that is driven by an electric motor (not shown). The cam 50 is disposed beneath a block 52. An actuating shaft 54 slidably extends through the block 52 with the bottom end thereof in engagement with the cam 50. The upper end of the shaft 54 is fixed to the actuator plate 9. In operation, rotation of the cam 50 actuates the shaft 54 upward thereby actuating the actuator plate 9. Preferably, a bias spring (not shown) acting on the shaft 54 is provided to bias the shaft 54 downward.

The shaft 54 is illustrated as being located approximate the center of the plate 9 in FIGS. 1 and 2A. However, in an embodiment where it is desired to pass cards through the indent printing apparatus 2, either to an output downstream from the apparatus 2 or to another mechanism, for example a second indent printing apparatus or another personalization mechanism, the actuator 8 would be changed to move the position of the shaft 54, for example to the edge of the plate 9, to permit cards to pass through the indent printing apparatus 2. In addition, it is to be realized that an actuator 8 other than the cam and shaft design can be used to actuate the plate 9.

The actuator plate 9 is attached to the top of the chassis 6 by a hinge mechanism 10 so as to be pivotable about an axis that is parallel to the y-direction. The first indenting mechanism 7*a* is connected to the plate 9 so as to be able to pivot with the plate 9 in the z-direction toward and away the second indenting mechanism 7*b*. The second indenting mechanism 7*b* is fixed in the x-, y- and z-directions. In use, the card travels between the first and second indenting mechanisms 7*a*, 7*b*.

The indent printing apparatus 2 also includes removable first and second indent printing ribbon cartridges 12*a*, 12*b* that provide first and second indent ribbons 15*a*, 15*b* for performing indent printing. Both the first and second indent printing ribbon cartridges 12*a*, 12*b* are insertable into and removable from the printer 1 and the indent printing apparatus 2, for example using a snap-fit system or any means that allows easy manual removal without requiring tools. The removal of the cartridges 12*a*, 12*b* allows the cartridges to be disposed of and replaced with new cartridges, or if desired, allows removal of the used indent ribbon and replacement with new indent ribbon.

Figure 2C:
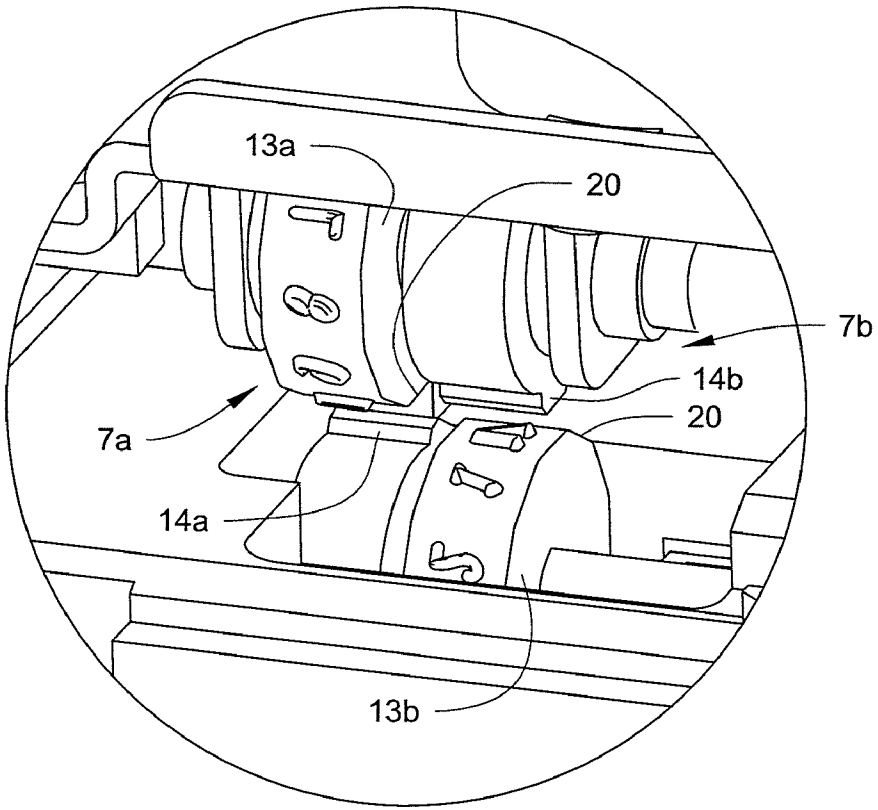
FIG. 2C is a perspective view of the first and second indenting mechanisms of FIG. 2B.
Figure 2B:
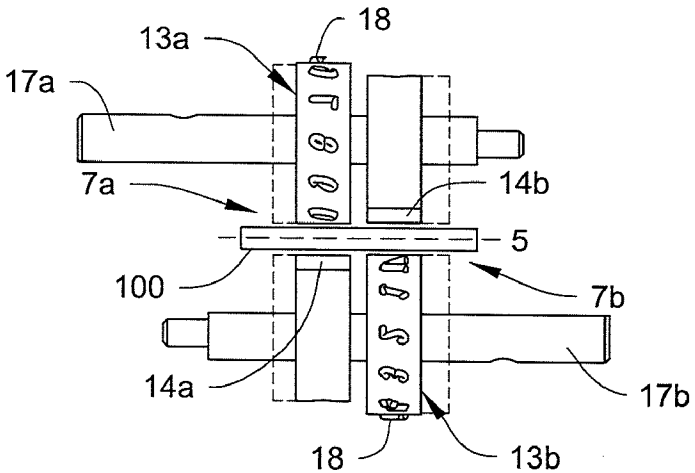
FIG. 2B is a perspective view of first and second indenting mechanisms.
Figure 2D:
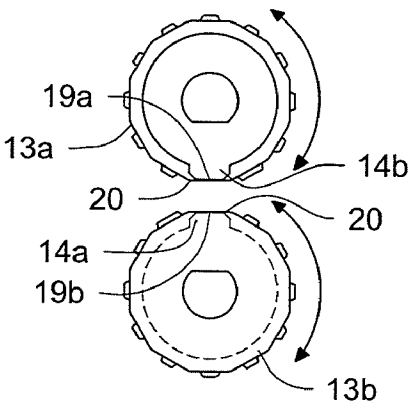
FIG. 2D is a side view of the first and second indenting mechanisms of FIG. 2B.
Figure 3:
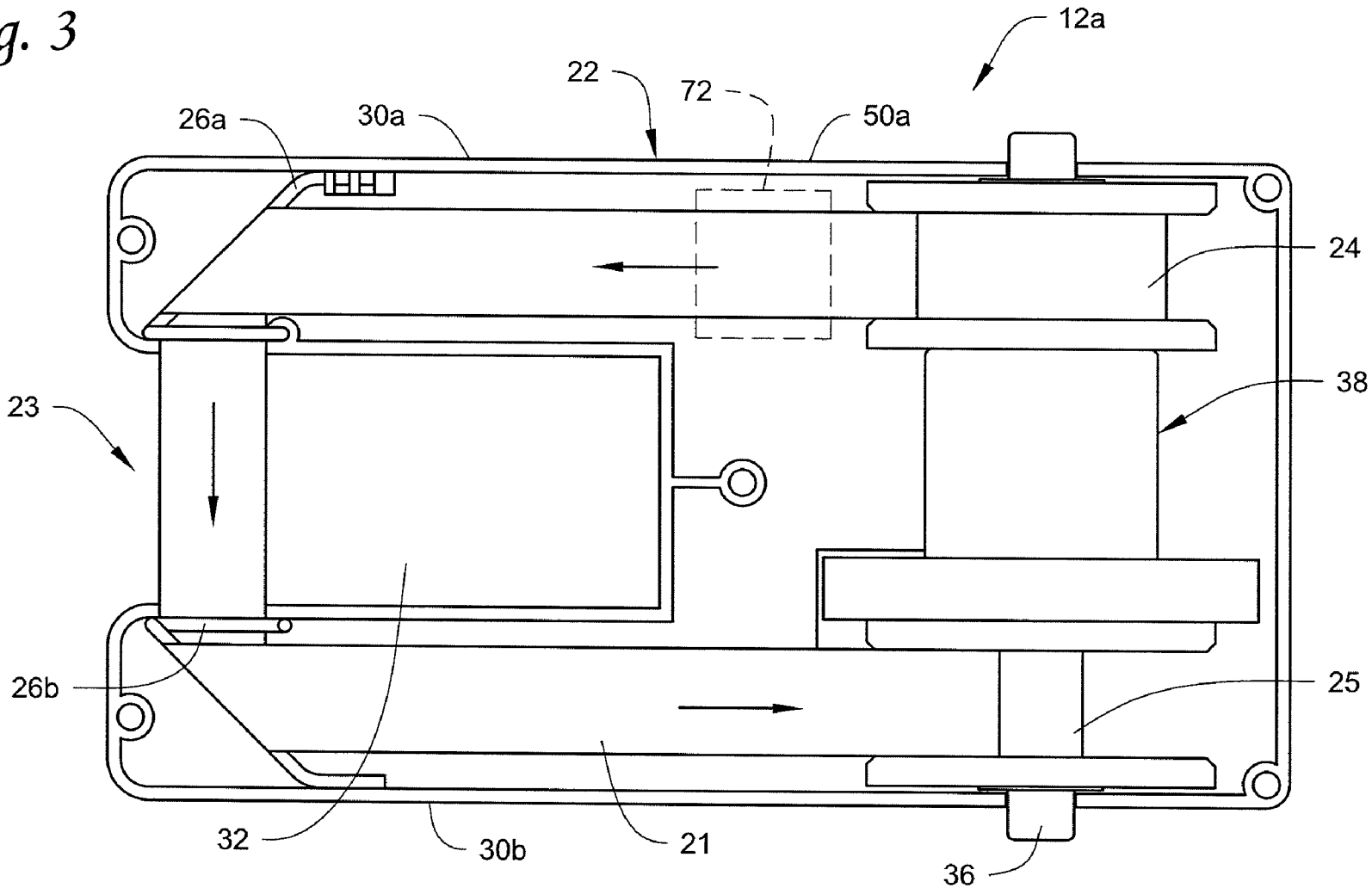
FIG. 3 is a top view of an indent ribbon cartridge for use with the indent printing apparatus, with the top part of the cartridge housing removed to show the inside of the cartridge.

The first and second indenting mechanisms 7*a, b* are now described in more detail with reference to FIGS. 2B, 2C and 2D. The first indenting mechanism 7*a* includes a first indent wheel 13*a* and a wheel disposed opposite the wheel 13*a* that includes a first anvil 14*a*. The first indenting mechanism 7*a* is positioned to perform indent printing on the first side surface of the card 100. The first indent wheel 13*a* and the first ribbon 15*a* are positioned on a first side of the card transport path 5 (illustrated in dashed lines in FIG. 2B) to contact the first side surface of the card. The first anvil 14*a* is positioned on a second side of the card travel path 5, generally opposite the first indent wheel 13*a* and the first ribbon 15*a*, to contact the second side surface of the card during indent printing by the first indent wheel 13*a*.

The second indenting mechanism 7*b* includes a second indent wheel 13*b* and a wheel opposite the indent wheel 13*b* that includes a second anvil 14*b*. The second indenting mechanism 7*b* is positioned to perform indent printing on the second side surface of the card. The second indent wheel 13*b* and the second ribbon 15*b* are positioned on the second side of the card travel path 5, adjacent the first anvil 14*a*, to contact the second side surface of the card. The second anvil 14*b*, which is adjacent the first indent wheel 13*a*, is positioned on the first side of the card travel path 5, generally opposite the second indent wheel 13*b* and the second ribbon 15*b*, to contact the first side surface of the card during indent printing by the second indent wheel 13*b*.

The first indent wheel 13*a* and the wheel containing the second anvil 14*b* are disposed on a first shaft 17*a* that is rotatable about an axis that is generally parallel to the y-direction. The second indent wheel 13*b* and the first anvil 14*a* are disposed on a second shaft 17*b* that is also rotatable about an axis that is generally parallel to the y-direction. The first and second indent wheels 13*a*, 13*b* and the first and second anvils 14*a*, 14*b* can be disposed on the first and second shafts 17*a*, 17*b* such that lateral adjustment of the first and second indent wheels 13*a*, 13*b* and the first and second anvils 14*a*, 14*b* along first and second shafts 17*a*, 17*b* can be achieved (illustrated in dashed lines in FIG. 2B). This allows the position of the indent wheels 13*a*, 13*b* to be set so as to achieve indent printing on the card at any location along the y-direction. In some implementations, for example when indenting is necessary on only one side of the card, the anvil may be fixed, i.e. not rotatable about an axis.

Both the first and second indent wheels 13*a*, 13*b* includes one or more indent characters 18 to be indent printed onto the first and second side surfaces of the card. In addition, each indent wheel 13*a*, 13*b* also includes a blank spot 20 that is devoid of an indent character. As shown in FIG. 2D, the blank spot 20 of the indent wheel 13*a* is positioned on the wheel 13*a* at a location corresponding to the anvil 14*b*, while the blank spot 20 of the indent wheel 13*b* is positioned on the wheel 13*b* at a location corresponding to the anvil 14*a*. The blank spots 20 permit a card to slide by the respective indent wheel 13*a*, 13*b* when that indent wheel is not currently being used to indent print. Further, the first and second anvils 14*a*, 14*b* are provided with upper surfaces 19*a*, 19*b*, respectively, that are flat and form flat surface anvil heads.

The indent characters 18 can include one or more letters, numbers, symbols or combinations thereof. FIG. 2D illustrates eleven indent characters 18 distributed about each of the first and second indent wheels 13*a*, 13*b*. However in other embodiments, more or less indent characters can be used. A symbol can be a stamp such as a government seal. In one embodiment, indent characters are provided on one or both of the first and second indent wheels 13*a*, 13*b* and set in a predetermined pattern to allow linear indent printing of the pattern generally across the first and/or second side surface of the card. The pattern could be, for example, a personal account number, a person or company name, or the like.

When the first and second disposable indent printing ribbon cartridges 12*a, b* are in position within the indent printing apparatus 2 (shown in FIG. 1), the first indent ribbon 15*a* is positioned on the first side of the card transport path 5 between the first indent wheel 13*a* and the card to contact the first side surface of the card during indent printing. The second indent ribbon 15*b* is positioned on the second side of the card transport path 5 between the second indent wheel 13*b* and the card to contact the second side surface of the card during indent printing.

In use, after a card is input into the housing 3 and is transported to and through the printer mechanism 27, a sensor (not shown) detects when the card enters the indent printing apparatus 2. When the card is properly positioned, the shafts 17*a*, 17*b* must be actuated to properly position the indent wheels 13*a*, 13*b* and the anvils 14*a*, 14*b* depending upon which side (or both) of the card is to be indent printed.

In the case of indent printing on the first side of the card, the shaft 17*b* is rotated to position the flat surface 19*a* of the anvil 14*a* facing upward in the z-direction toward the indent wheel 13*a*. The shaft 17*a* is also rotated to bring the appropriate character of the indent wheel 13*a* into position opposite the anvil 14*a*. The cam 50 is then rotated to raise the shaft 54, which causes the actuator plate 9 to pivot downward. This drives the positioned character of the indent wheel 13*a* and the indent ribbon 15*a* into engagement with the first side of the card to indent print the character into the first side of the card. The indent wheel 13*a* is then raised upwardly by the appropriate spring bias and a new character of the indent wheel 13*a* is brought into position if additional indent printing on the first side is needed.

In the case of indent printing on the second side of the card, the shaft 17*a* is rotated to position the flat surface 19*b* of the anvil 14*b* facing downward in the z-direction toward the indent wheel 13*b*. The shaft 17*b* is also rotated to bring the appropriate character of the indent wheel 13*b* into position opposite the anvil 14*b*. The cam 50 is then rotated to raise the shaft 54, which causes the actuator plate 9 to pivot downward. This drives the anvil 14*b* downward which pushes the card, and the second side surface thereof, into engagement with the ribbon 15*b* and the character on the indent wheel 13*b* which indent prints that character into the second side surface. The indent wheel 13*a* is then raised upwardly by the appropriate spring bias and a new character of the indent wheel 13*b* is brought into position if additional indent printing on the second side surface is needed.

Indent printing is only performed when the respective anvils 14*a*, 14*b* are positioned opposite the respective first and second indent wheels 13*a*,13*b*. Indent printing using the apparatus 2 would typically be performed on one side surface of the card in one pass of the card. If indent printing is required on the opposite side surface of the card, the card would then be reversed in direction back through the indenting apparatus and then re-directed through the indenting apparatus to indent print on the opposite side surface in a second pass of the card. However, the indent printing apparatus 2 could simultaneously indent print on each side surface of the card during a single pass of the card through the apparatus.

The first and second removable indent printing ribbon cartridges 12*a*, 12*b* are now described in more detail with reference to FIGS. 3-7. The cartridges 12*a*, 12*b* are identical, so only the cartridge 12*a* will be discussed in detail. The indent printing ribbon cartridge 12*a* has a housing 22 with an interior space and an exposed ribbon zone 23. The housing 22 comprises a lower half 50*a* and an upper half 50*b* (visible in FIG. 2A). In cases where one desires to be able to replace the indent ribbon rather than dispose of the cartridge 12*a* once the ribbon is used up, the lower and upper halves 50*a*, 50*b* are preferably detachably connected to each other or are otherwise moveable relative to each other to permit the housing 22 to be opened for access to the ribbon to allow ribbon replacement.

Enclosed within the interior space of the housing 22 is a supply reel 24 for supplying unused indent ribbon 21, a take-up reel 25 for storing used indent ribbon 21 and a pair of ribbon guides 26*a, b*. The supply reel 24 and take-up reel 25 are disposed on a shaft 36 that extends through the reels 24, 25 and which is supported at either end by the housing 22. The ribbon 21 is replaceable by, for example, replacing the supply reel 24 and the take-up reel 25 with new reels.

The shaft 36 is preferably driven by a suitable motor or motors (not shown) when the cartridges 12*a*, 12*b* are mounted into the printer 1. A clutch mechanism 38, or other resistance mechanism that performs a function similar to the clutch mechanism, later described in FIGS. 4-7, is provided on the shaft 36 between the reels 24, 25 to provide tension on the ribbon supply side.

The housing 22 includes a pair of spaced arms 30*a*, 30*b* that extend from the portion of the housing 22 containing the supply reel 24 and take-up reel 25. The ends of the arms 30*a*, 30*b* are spaced from each other to define a space 32 including the exposed ribbon zone 23.

The ribbon guides 26*a*, 26*b* are disposed near the ends of the arms 30*a*, 30*b* and are each configured for turning the indent ribbon 90 degrees as the ribbon travels from the supply reel 24 to the take-up reel 25. In particular, the ribbon guides 26*a*, 26*b* comprise wire guides that are fixed in the arms 30*a*, 30*b*, with the ribbon engaging portion of the guides 26*a*, 26*b* disposed at approximately a 45 degree angle to the path of travel of the ribbon. The guide 26*a* causes the ribbon to turn 90 degrees from its initial direction of travel (shown by the arrow in FIG. 3) as the ribbon leaves the supply reel 24. The ribbon then exits the arm 30*a* so that it is exposed outside of the housing 22 in the exposed ribbon zone 23 to be accessible for indent printing. The ribbon then enters the end of the arm 30*b*, and is turned 90 degrees by the guide 26*b* in a direction parallel to the ribbon in the arm 30*a* where the ribbon then is taken up on the take-up reel 25.

While ribbon 21 is advanced from the supply reel 24 to the take-up reel 25, the effective diameters of each reel change. This change in diameters creates a problem while trying to achieve a consistent, incremental ribbon advance distance throughout the entire reel. Therefore, the cartridge 12*a* is provided with the clutch mechanism 38 to achieve consistent, incremental advancement throughout the length of the ribbon, utilizing a small number of inexpensive components, and one motor.

Figure 5:
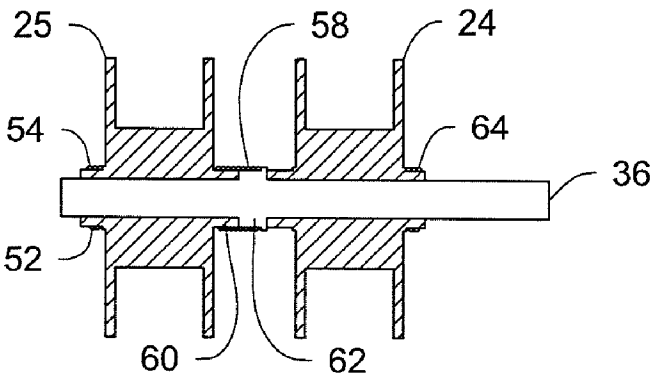
FIG. 5 is a sectional view through the supply and take-up reels of the cartridge.
Figure 4:
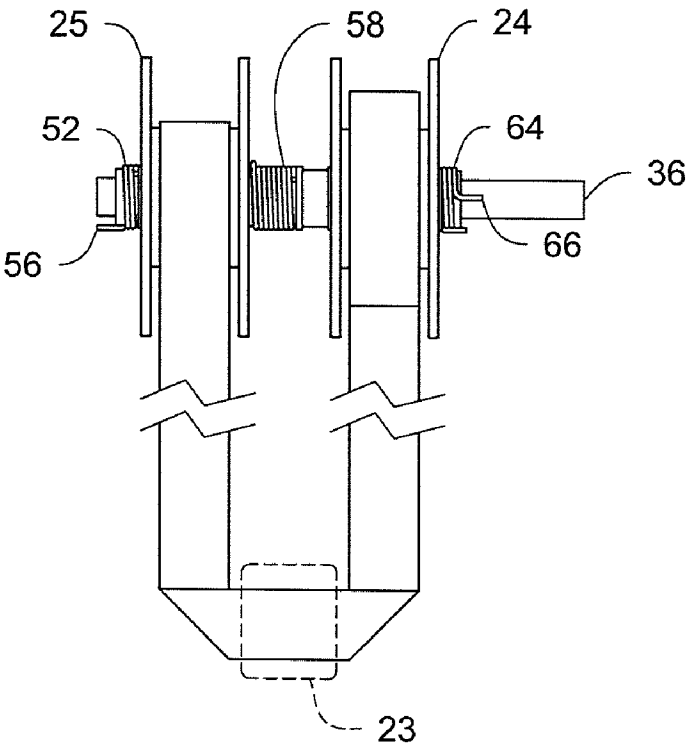
FIG. 4 illustrates the internal components of the ribbon cartridge including a mechanism for controlling ribbon feeding.

With reference to FIGS. 4 and 5, the take-up reel 25 includes a wrap clutch spring 52 that is disposed around a stub shaft 54 of the reel 25. The reel 25 is clutched to the housing 22 through the engagement of a spring tang 56 on the clutch spring 52 with a feature in or on the housing 22. The clutch spring 52 allows rotation of the take-up reel 25 in one direction (i.e. a take-up direction) only preventing payout direction rotation of the take-up reel. The take-up reel 25 is also clutched to the drive shaft 36 through a drive clutch spring 58 disposed around a stub shaft 60 on the reel 25 and an enlargement 62 formed on the shaft 36. The drive clutch spring 58 sets the take-up torque transferred from the drive shaft 36 to the take-up reel 25 for controlling torque and rotation of the take-up reel relative to the drive shaft, allowing a simplified take-up operation wherein the motor that drives the shaft 36 runs for a set period of time regardless of reel diameters. Once the ribbon slack is removed, the clutch 58 simply slips until the motor run period expires. Motor run period is set so that it is sufficient for empty take-up diameter.

The supply reel 24 is clutched to the cartridge housing 22 by a wrap clutch spring 64 through the engagement of a supply spring tang 66 with a feature in or on the housing 22. The wrap clutch spring 64 prevents the supply reel 24 from rotating in the pay-out direction unless released by a clutch release pin 68 shown in FIG. 6 allowing selective payout rotation of the supply reel.

Figure 7:
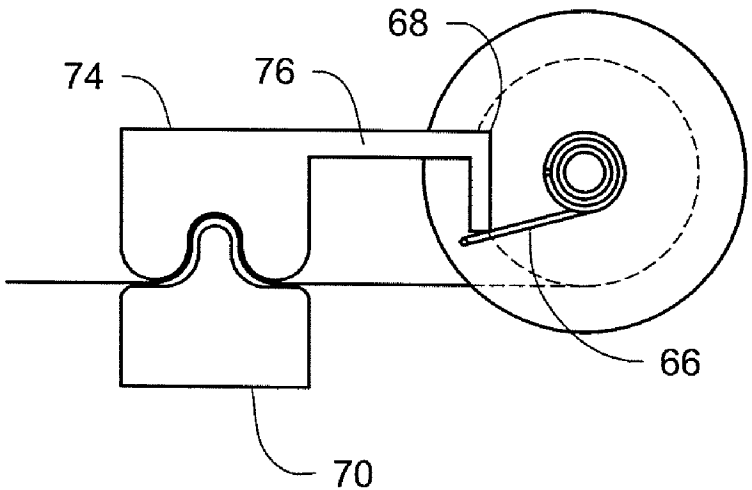
FIG. 7 is a side view similar to FIG. 6 with the jaw mechanism closed.
Figure 6:
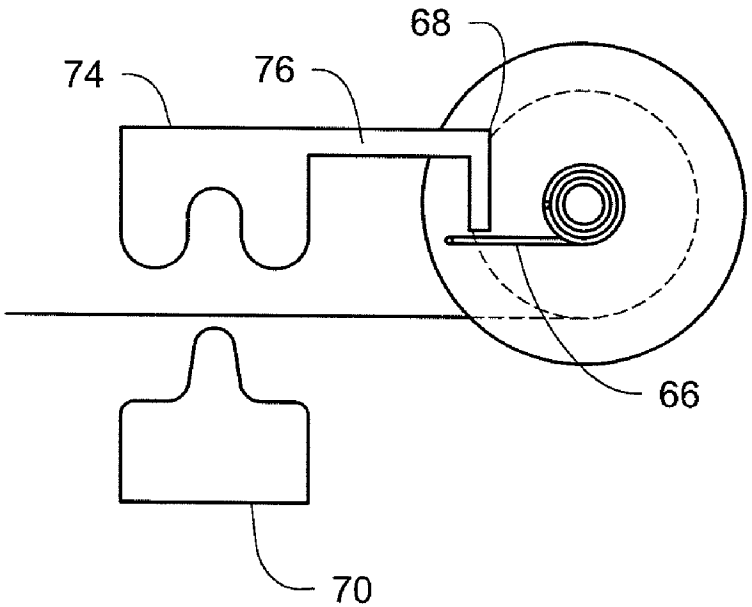
FIG. 6 is a side view of the supply reel illustrating a jaw mechanism that controls ribbon feeding, with the jaw mechanism open.

The clutch mechanism 38 also includes a mechanism for controlling the clutch spring 64. For example, as illustrated in FIGS. 6 and 7, that mechanism can include a bottom labyrinth 70 that is mounted and fixed to the stationary portion of the indenting apparatus 2 to which the indent mechanism 7*b* is rotatably fixed. The bottom labyrinth 70 can extend upwardly through a hole 72 (shown in dashed lines in FIG. 3) provided in the arm 30*a* or other portion of the housing 22 when the cartridge is inserted into position. The mechanism can also include a top labyrinth 74 that is mounted and fixed to the plate 9 so as to be moveable with the plate 9 toward and away from the bottom labyrinth 70. The top labyrinth 74 can extend through a hole (not shown) in the housing 22 that is positioned opposite the hole 72. The clutch release pin 68 is connected to the end of an arm 76 that is connected to the top labyrinth 74.

One or more resistance mechanisms other than clutches can be used in the resistance mechanism 38, as long as the resistance mechanisms perform functions similar to the individual clutches of the clutch mechanism 38.

In use, the cartridge is inserted into the indent apparatus 2. The printer 1 then initializes, running the take-up motor connected to the shaft 36 to remove slack in the ribbon. The labyrinth then closes by bringing the top labyrinth 74 into engagement with the bottom labyrinth 70 as a result of the plate 9 being actuated downward to bring the indent mechanism 7*a* toward the indent mechanism 7*b*. When the labyrinth closes, a character is indented onto the card. In addition, the wrap clutch spring 64 is released by the clutch release pin 68, and an increment of ribbon is pulled from the supply reel 24 around the labyrinth. As shown in FIG. 6, the pin 68 is in contact with the spring tang 66, but the spring tang 66 is still in the horizontal position. As shown in FIG. 7, when the pin has moved down with the top labyrinth 74, it pushes the spring tang 66 down. By pushing the spring tang 66 down, the wrap-spring clutch 64 is opened thereby releasing the supply reel 24 allowing the reel 24 to rotate relative to the shaft 36 to feed ribbon.

When the plate 9 is raised upward, the labyrinth is opened by raising the top labyrinth 74 upward with the plate 9. At the same time, the clutch release pin 68 lifts upward, and the supply clutch spring 64 locks the supply reel 24. The take-up motor connected to the shaft 36 then runs, removing ribbon slack.

Other methods for advancing ribbon are possible. For example, a motor can be used to rotate the take-up reel 24 by a set amount after every indenting operation. In this embodiment, the incremental amount of linear ribbon payout will increase substantially from empty to full take-up reel 25. Therefore, electronics and code would be required in this embodiment in order to account for the increasing take-up reel diameter, and continually adjust the amount of motor rotation per increment.

Another option is to create a "nip" between a pair of rollers, and drive the ribbon using the friction of the rollers. This nip would be located on the ribbon somewhere between the supply and take-up reels, and would allow for consistent rotational motor to linear payout ratio. The take-up reel would then be clutched to a separate motor, so that it could take-up the resulting slack.

If desired, the cartridge 12*a*, 12*b* can contain a smart radio frequency identification ("RFID") tag that contains an antenna and a memory element for storing data, for example data relating to ribbon use and the amount of ribbon remaining, for example a count based on the anticipated amount of ribbon used. The RFID tag can be mounted on the housing 22, including on the exterior thereof or on the interior thereof, or on some component of the cartridge other than the housing 22. For example, the RFID tag can be mounted on the supply reel 24, on the take-up reel 25 or on the shaft 36.

The above-described embodiments have all included one or more indent ribbon cartridges containing indent print ribbon. However, it is possible to utilize the card printer 1 and the indent printing apparatus 2 together to indent print characters without using the indent print ribbon.

In one such embodiment, a character can be printed onto the card by the print mechanism 27. Thereafter, the indent printing apparatus 2 can indent the same character in the same location as the printed character. The result is a character that appears to have been infilled with a color material, and the character appears similar to an indented character using the indent printing technique described in detail above.

In a second embodiment, a plurality of characters are indented into the card. Thereafter, a solid, colored box or field is printed around the indented characters by the print mechanism 27 without printing within the indented characters. As a result, the indented characters will stand out relative to the surrounding colored field. For example, the indented characters may look white in a black field.

Therefore, as used herein, indent printing apparatus and indent printing mechanism includes a device with indent capability with or without an indent print ribbon. In addition, the term "indent printing" and the like include indenting of characters with our without the use of indent ribbon.

The invention claimed is:

1. A desktop card printer, comprising:

a housing with an input and an output, both the input and the output being at one end of the housing;

a print mechanism within the housing that is configured to print on a card having first and second side surfaces;

an indent printing apparatus within the housing after the print mechanism and configured to indent print on a card, the indent printing apparatus including:

a first indent wheel positioned on a first side of a card transport path through the indent printing apparatus and positioned to contact the first side surface of the card, the first indent wheel is rotatable about an axis that is generally perpendicular to the card transport path and parallel to the first and second side surfaces; and the first indent wheel including at least one indent character;

a first anvil positioned on a second side of the card transport path generally opposite the first indent wheel and positioned to contact the second side surface of the card; and a first indent ribbon on the first side of the card transport path;

a card transport mechanism configured to transport a card from the input to the print mechanism and the indent printing apparatus, and to transport a card from the indent printing apparatus back through the print mechanism to the output.

2. The desktop card printer of claim 1, comprising an x-direction along the card transport path, a y-direction perpendicular to the x-direction and parallel to the first and second side surfaces of the card, and a z-direction perpendicular to the x-direction and the y-direction; and the first indent wheel and the first anvil are fixed in the x-direction and the y-direction.

3. The desktop card printer of claim 1, further comprising:

a second indent wheel positioned on the second side of the card transport path and positioned to contact the second side surface of the card, the second indent wheel is rotatable about an axis that is generally parallel to the rotation axis of the first indent wheel, and the second indent wheel including at least one indent character;

a second anvil positioned on the first side of the card transport path generally opposite the second indent wheel and positioned to contact the first side surface of the card; and a second indent ribbon on the second side of the card transport path.

4. The desktop card printer of claim 3, wherein the first and second indent ribbons are part of first and second indent ribbon cartridges, and the cartridges are removable from the desktop card printer.

5. A method of indent printing using the desktop card printer of claim 1, comprising:

printing a character onto a card using the print mechanism; and indenting the same character in the card at the same location as the printed character using the indent printing apparatus, whereby the indented character has the appearance of being infilled.

6. A method of indent printing using the desktop card printer of claim 1, comprising:

indenting a plurality of characters into a card using the indent printing apparatus; and printing a colored field around the indented characters using the print mechanism.

7. The method of claim 6, wherein the colored field has a color that differs from the color of the indented characters.

8. The desktop card printer of claim 1, further comprising an indent printing ribbon cartridge supplying the first indent ribbon, the indent printing ribbon cartridge including:

a housing having an interior space and first and second spaced arms;

a supply reel containing the first indent ribbon to be used and a take-up reel for taking up the first indent ribbon that has been used, the supply reel and the take-up reel are disposed in the interior space;

a ribbon guide in each of the first and second arms, each ribbon guide is configured to turn the first indent ribbon 90 degrees as it travels along a travel path from the supply reel to the take-up reel; and the first and second arms are spaced from each other adjacent ends thereof to define an exposed ribbon zone, the exposed ribbon zone exposing the first indent ribbon to the exterior of the housing as the first indent ribbon travels along the travel path to allow the first indent ribbon to be used by the indent printing apparatus for indent printing.

9. The desktop card printer of claim 8, wherein the supply reel and take-up reel are rotatable about a common axis.

10. The desktop card printer-of claim 8, wherein the travel path includes a first portion through the first arm, a second portion through the exposed ribbon zone, and a third portion through the second arm, and wherein the first portion is parallel to the third portion, and the second portion is perpendicular to the first portion and the third portion.

11. The desktop card printer of claim 8, further comprising a drive shaft, a clutch between the drive shaft and the take-up reel for controlling torque and rotation of the take-up reel relative to the drive shaft, a clutch between the housing and take-up reel preventing payout direction rotation of the take-up reel, and a clutch between the housing and supply reel allowing selective payout rotation of the supply reel.

12. A method of processing a card in the desktop card printer of claim 1, comprising:

inputting the card into the desktop card printer through the input;

transporting the card to the print mechanism;

personalizing the card using the print mechanism;

transporting the card to the indent printing apparatus;

transporting the card through the indent printing apparatus and indent printing on the card using the indent printing apparatus; and transporting the card in a reverse direction back through the indent printing apparatus and through the print mechanism to the output.

13. The method of claim 12, further comprising outputting the card from the desktop card printer through the output.

* * * * *